US006205726B1

(12) United States Patent
Hoadley

(10) Patent No.: US 6,205,726 B1
(45) Date of Patent: Mar. 27, 2001

(54) INSULATED MASONRY BLOCK AND WALL

(76) Inventor: Theodore A. Hoadley, 7688 N. 7 Rd., Mesick, MI (US) 49668

( * ) Notice: Subject to any disclaimer, the term of this patent is extended or adjusted under 35 U.S.C. 154(b) by 0 days.

(21) Appl. No.: 09/306,664

(22) Filed: May 5, 1999

(51) Int. Cl.[7] ..... E04C 1/00

(52) U.S. Cl. ..... 52/309.12; 52/592.6; 52/604; 52/606

(58) Field of Search ..... 52/309.12, 426, 52/404.4, 592.6, 604, 606, 607

(56) References Cited

U.S. PATENT DOCUMENTS

| | | | | |
|---|---|---|---|---|
| 3,982,369 | * | 9/1976 | Keleske | 52/407 |
| 4,584,043 | | 4/1986 | Riefler . | |
| 4,614,071 | * | 9/1986 | Sams | 52/309.12 |
| 4,745,720 | | 5/1988 | Taylor . | |
| 4,802,318 | * | 2/1989 | Snitovski | 52/309.12 |
| 5,186,883 | | 2/1993 | Beall, III . | |
| 5,189,859 | * | 3/1993 | Payer | 52/585 |
| 5,209,037 | | 5/1993 | Kennedy et al. . | |
| 5,697,189 | | 12/1997 | Miller et al. . | |

* cited by examiner

*Primary Examiner*—Carl D. Friedman
*Assistant Examiner*—Kevin McDermott
(74) *Attorney, Agent, or Firm*—Douglas S. Bishop

(57) ABSTRACT

An insulated concrete block and wall assembly. The primary element is an insulated block which consists of two rectangular concrete facings and a rigid solid insulating core. The concrete facings are attached by adhesive to the insulating core. The insulating core has apertures within it to allow vertical reinforcing rod support in a constructed wall. The invention additionally provides an indentation along the top of each insulating core to provide for horizontal re-rod support within the wall itself. The invention provides optimal decrease in thermal conductivity coupled with simplicity of design and transport.

31 Claims, 5 Drawing Sheets

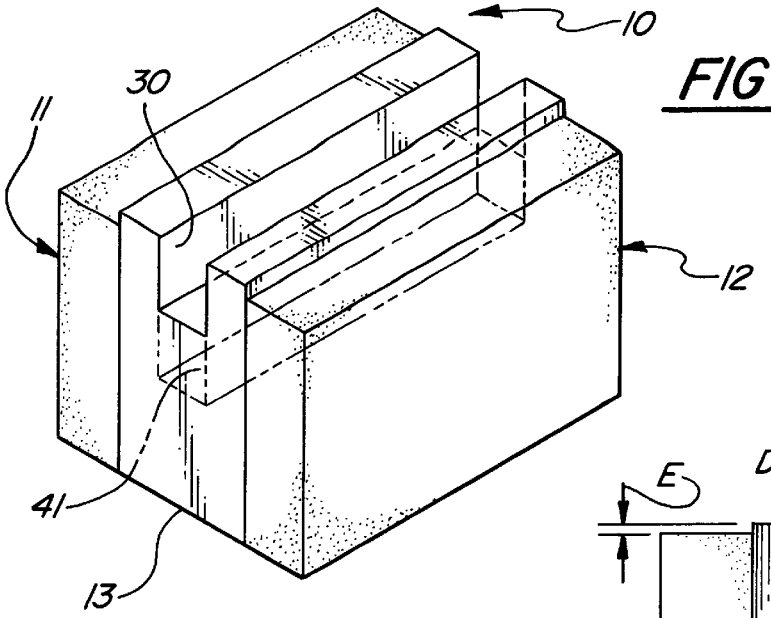
FIG - 1
FIG - 2
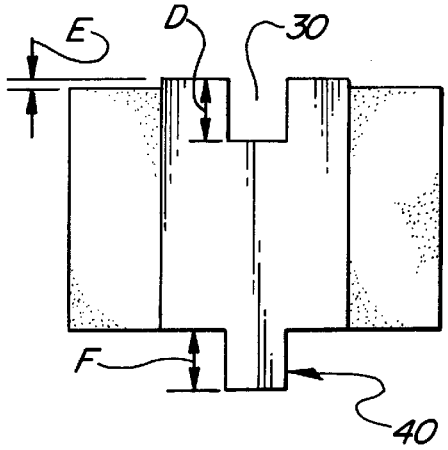
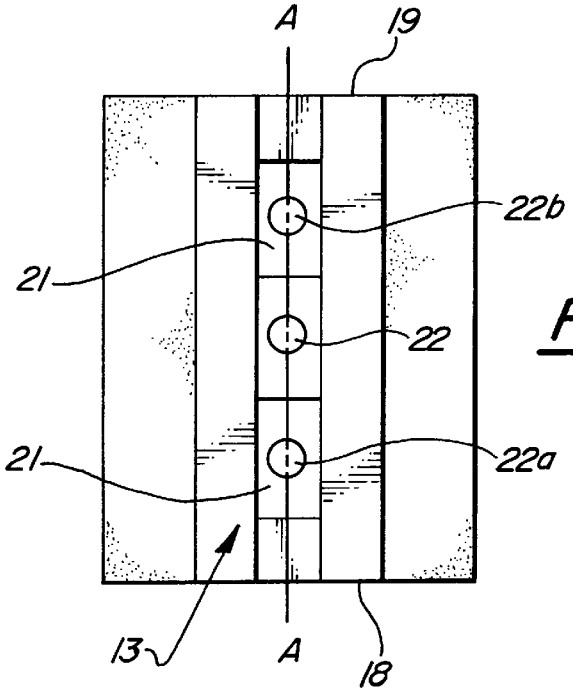
FIG - 3
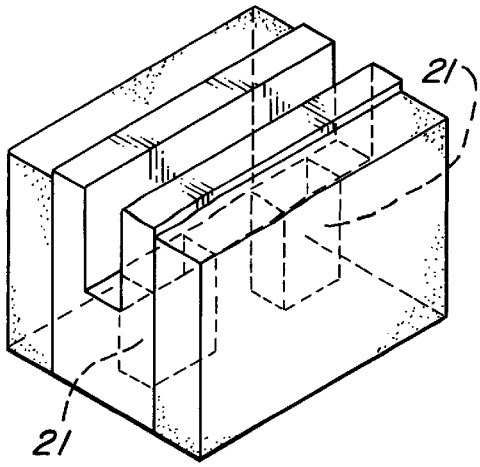
FIG - 4

91
63
64e
63f
63a
C1
64
C3
64c
63c
C4
C4
64f
64a
61
B
A
63c
A
60
63f
64e
A
A
64d
63e
64c
64b
63d
63b
64
63e
64f
63d
63
63a
64a
62
64d 11
11c
A
11f
10
16
C
15
19
11e
12c
B
11a
20
90°
A
90°
11b
C
11d
14
B
12a
13
18
17
12b
90°
12
12e
12d

FIG-6
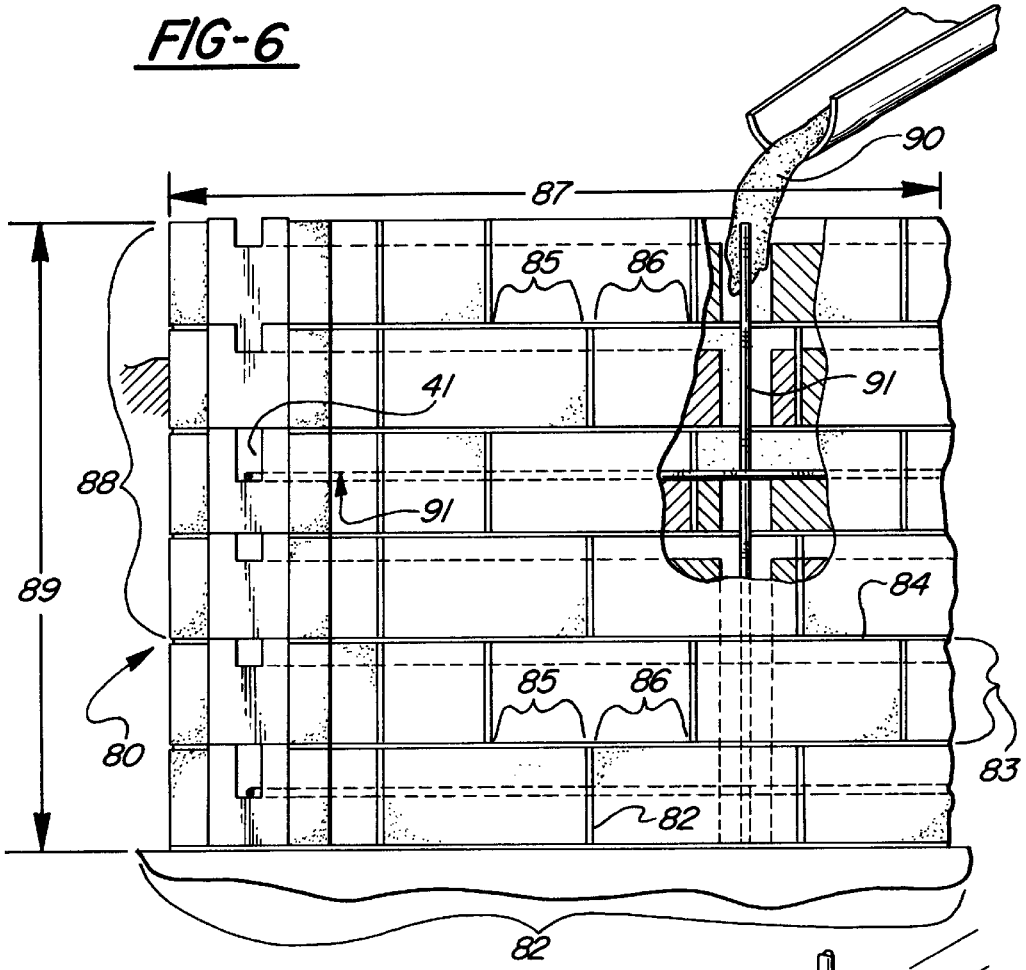
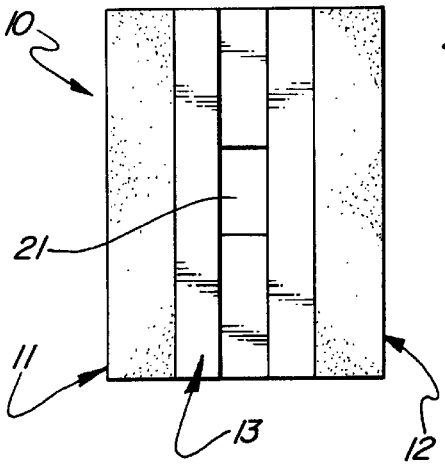
FIG-8
FIG-9
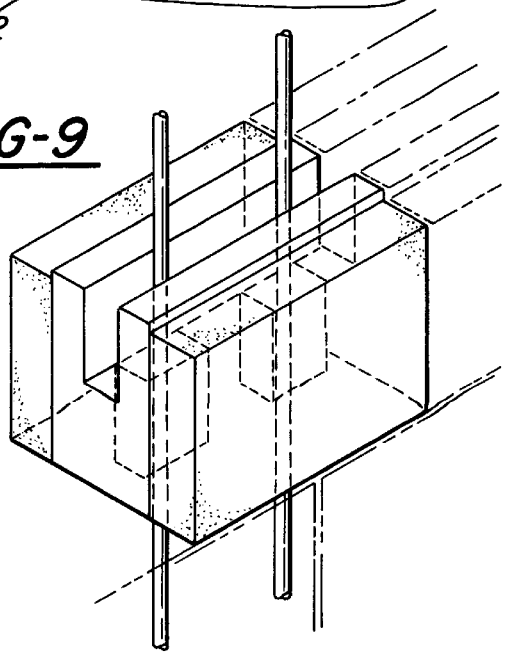

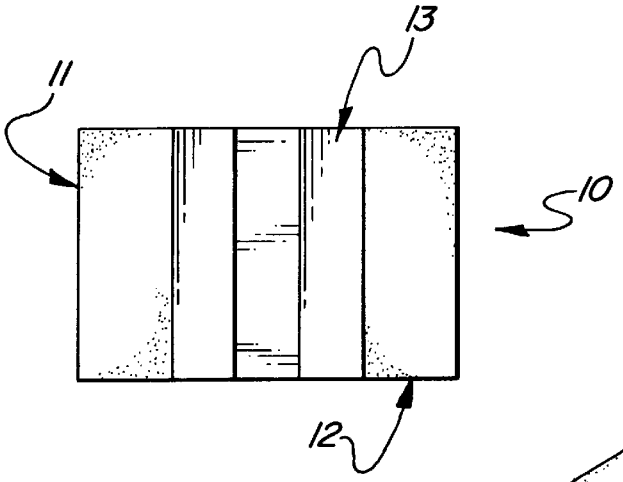
FIG-10
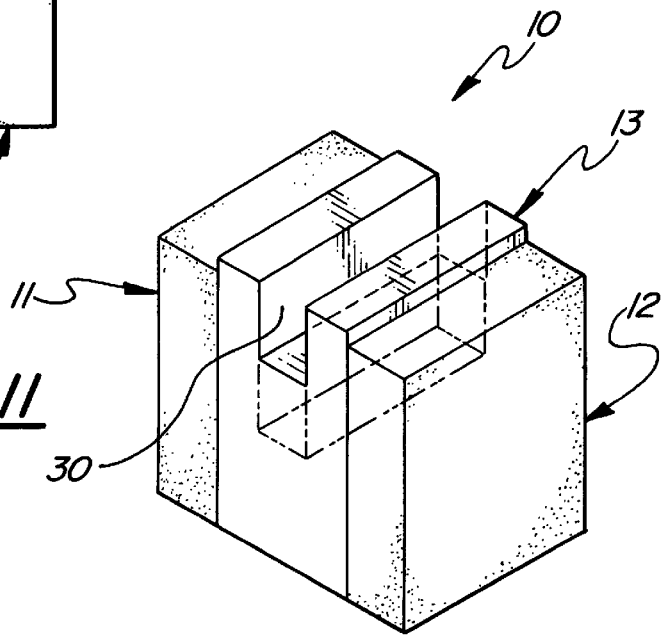
FIG-11
FIG-12
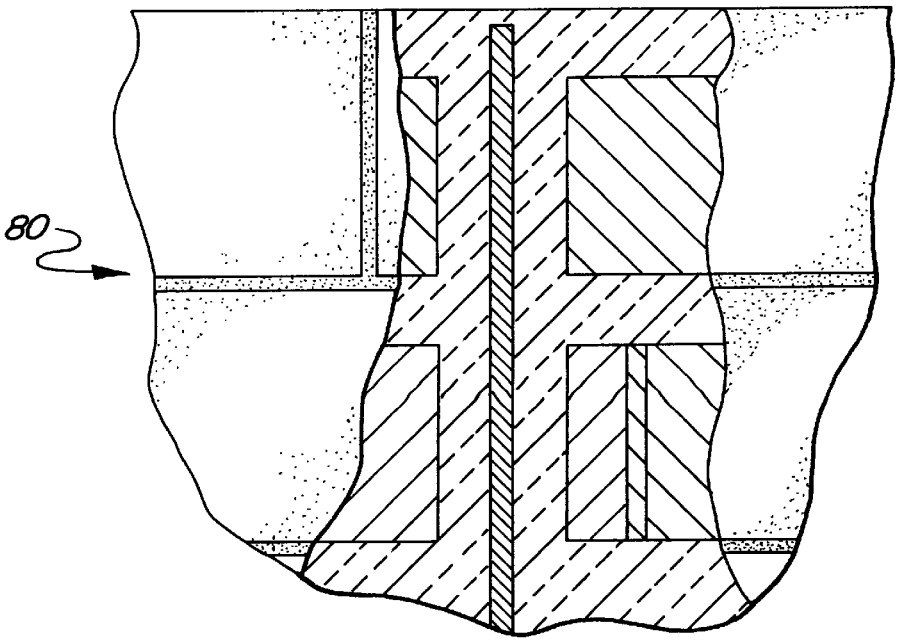

INSULATED MASONRY BLOCK AND WALL

BACKGROUND OF THE INVENTION

This invention relates to masonry blocks and, more specifically, to masonry blocks which decrease thermal conductivity by utilization of non-masonry core materials.

Traditional concrete blocks have been of unitary construction with cross members and face members all formed of the same material, namely, concrete. An important consideration in masonry blocks is thermal resistence. The thermal resistence of a particular material is a relative measure of how quickly the material, block or assembly will allow heat to pass through it. In building and engineering terms, thermal resistence is referred to in terms of R-value. The more slowly the heat is allowed to pass through a material, the higher that material's thermal resistence is and, correspondingly, the higher the R-value which will be assigned to that particular material.

Traditional concrete blocks have spaces between cross members which may be filled with insulating material to increase the R-value of a wall or other structure constructed with the blocks. Such installation applications, however, have no affect on the thermal resistance of the concrete cross members in traditional masonry blocks. Adaptations of traditional concrete masonry blocks have been made to facilitate insertion of foam or other insulation material still utilizing a traditional block structure. It is also known to utilize light-weight concrete forms and non-masonry connecting members for these forms, into which concrete is poured to form a central concrete core. Other approaches have utilized exterior insulation on existing support concrete walls with insulation materials which adhere to the outside of the concrete support wall. Variations on this include a decorative, protective "skin." The prior art, however, does not disclose a block of traditional concrete size and load-bearing capability, attached to and separated by a uniform, solid insulating core which is manufactured and then delivered and installed as a one-piece unit.

While much of the prior art has been directed toward the construction of masonry walls using concrete blocks, with a goal of providing an ultimate wall of significantly increased R-value, the examples of prior art do not address the improvements of the present invention.

Traditional cement masonry building blocks generally contain rectangular face elements which, when utilized in construction of walls, are generally laid end to end and on top of each other in an essentially vertical plane to maintain structural and load-bearing support. Additionally, there are concrete cross members which hold the face elements of the block together at the desired interval. These are not essential elements, however, for load-bearing stability once the blocks are in place.

Examples of other attempts to address this problem include U.S. Pat. No. 5,697,189, to Millar et al, which discloses a monolithically poured concrete wall panel. U.S. Pat. No. 5,209,037, to Kennedy et al, for a building block insert, discloses a substantially serpentine integral insert and two outer supportive parts. U.S. Pat. No. 4,745,720, to Taylor, discloses an insulated cinder block split into two portions. U.S. Pat. No. 4,802,318, to Snitoviski, discloses an insulated block unit comprised of two building blocks strapped about an insulating core.

Any masonry block application which will allow for greater R-factor of an overall finished wall will result in lesser insulation requirements and the balance of construction and will result in significant cost savings and commercial advantage to the builder or, likewise, in the event that additional insulation is not added, in greater savings in cooling and/or heating costs to the owner of any completed structure.

Accordingly, irrespective of the prior art, a need continues to exist for an insulated masonry block which does not require separate assembly; which does not sacrifice vertical load-bearing capacity; yet which continues to provide a traditional two-sided exterior masonry surface which allows an overall uniform thermal resistence of the interior wall significantly greater than concrete.

Specifically, what is needed is an assembled masonry block having traditional load-bearing side elements, which may be stored, and utilized in construction in the same manner as traditional concrete blocks.

SUMMARY OF THE INVENTION

This invention is directed to the provision of a unitary masonry block wall which may be assembled in the same manner and which will provide the same appearance as a standard traditional concrete masonry block and wall but which will provide significant advantages with regard to uniform thermal resistence.

More specifically, the present invention is directed to the provision of a concrete masonry block and a wall constructed of concrete masonry blocks which provide standard, traditional rectangular outer concrete surfaces which provide the same appearance and surface integrity as traditional concrete blocks and provide the same structural and load-bearing capacity as well, but which blocks have a completely unitary rigid insulating core, lighter in weight than traditional concrete, but which is sufficient, with the use of adhesive, to hold the block together for shipping, storage and assembly within a wall.

The present invention will provide a masonry block, and completed masonry wall, with a high thermal resistence rating (R-factor) between the external surface faces of the block.

According to another important feature of the present invention, the insulating core of the block may be formed of apertures or grooves to facilitate the insertion of reinforcing rod, or other structural supports, to provide further vertical and horizontal integrity to a finished wall.

According to a further feature of the invention, the cavities provided for utilization of reinforcing rod, may be further utilized for fill with concrete material for further stability, or with insulation material for further thermal resistence.

The above and additional features of the invention may be considered and will become apparent in conjunction with the drawings in particular, and the detailed description which follows:

BRIEF DESCRIPTION OF THE DRAWINGS

The following detailed description is best understood by reference to the following drawings, in which:

FIG. 1 is a perspective view of an insulated masonry block device, additionally depicting the greater depth of the surface indentation in an alternative preferred embodiment;

FIG. 2 is an end view of an alternative preferred embodiment of an insulated masonry block device showing the slot defined by the upper surface of the rigid insulation core and the protrusion on the base of said core;

FIG. 3 is a top view of the insulated masonry block device;

FIG. 4 is a perspective view of the insulated masonry block device with hidden lines showing the vertical apertures defined by the insulating core member;

FIG. 6 is a cut-away view of a section of an insulated masonry block wall assembly showing a vertical and horizontal support rod within said assembly and further showing mortar being poured within said assembly to complete the vertical and horizontal support members;

FIG. 8 is a top view of an insulated masonry block device having a single vertical aperture;

FIG. 9 is a perspective view of an insulated masonry block device, showing the same, in relationship with a pair of vertical support members, and adjoining masonry blocks in two courses of a masonry block wall assembly;

FIG. 10 is top view of an adjusting insulated masonry block device;

FIG. 11 is a perspective view of an adjusting insulated masonry block device showing alternative depths of the indentation in the surface of the insulating core member;

FIG. 12 is a cut-away view of a section of an insulated masonry block wall assembly showing horizontal and vertical support members comprised of a combination of poured mortar and rigid support rods;

DETAILED DESCRIPTION OF THE PREFERRED EMBODIMENT

Figure 5:
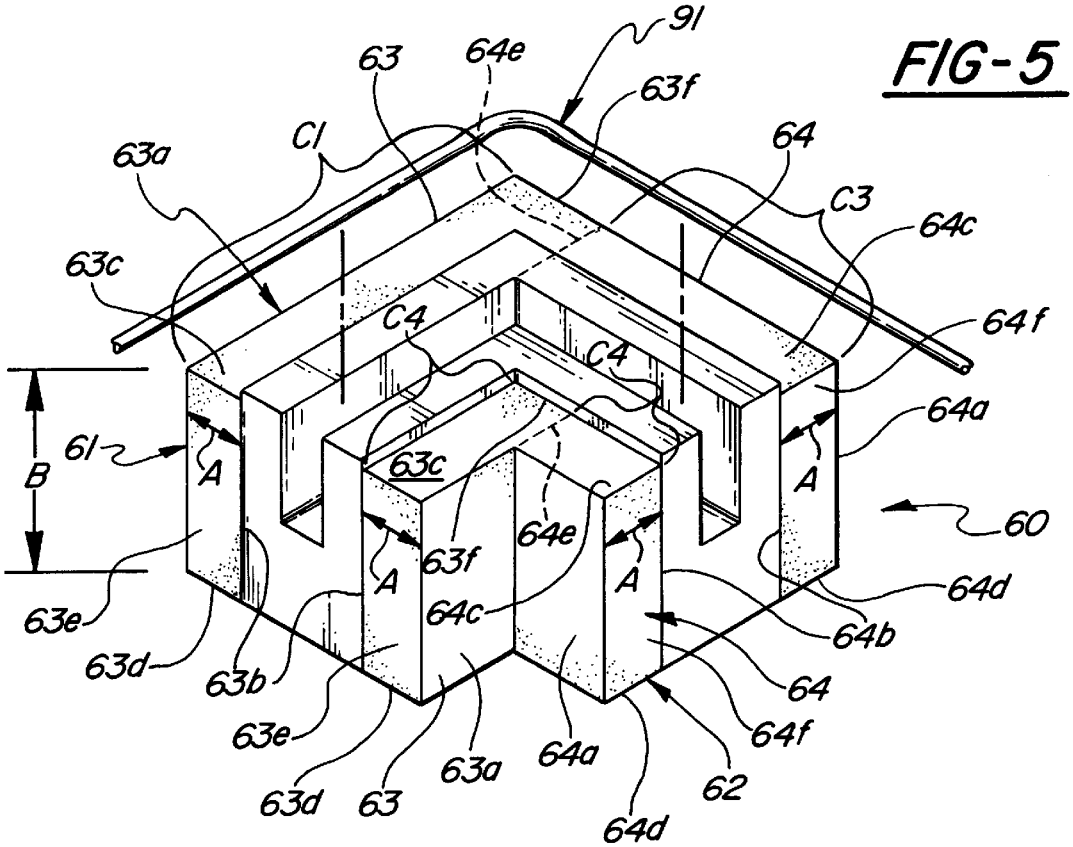
FIG. 5 is a perspective view of the insulated corner block embodiment of the invention, showing a rigid support member in exploded relationship to the corner block.

The invention insulated masonry block, broadly considered, includes a block 10 and an insulated block wall assembly 80.

Block 10 includes a first masonry facing member 11, a second masonry facing member 12 and a core member 13. Facing members 11 and 12 are formed of concrete in the preferred embodiment. Core member 13 is comprised of a rigid insulating material which, in the preferred embodiment, may be polystyrene or a similar substance.

Figure 7:
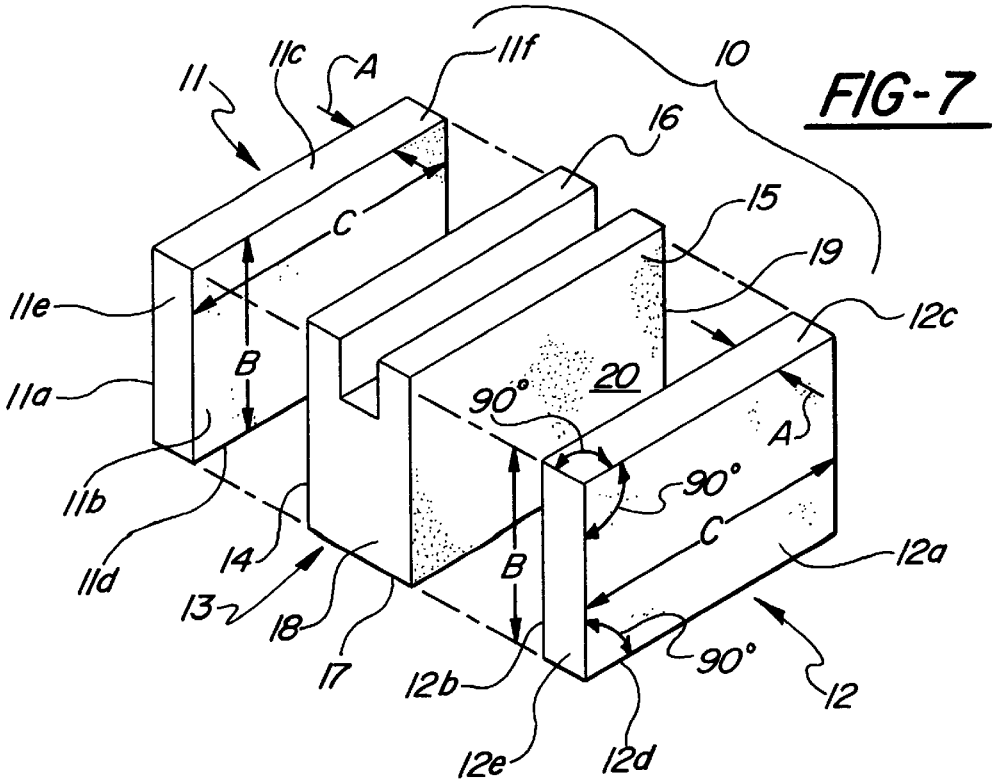
FIG. 7 is an exploded perspective view of an insulated masonry block device.

Each of the facing members 11 and 12, is substantially rectangular in three dimensions as shown in the exploded view of FIG. 7. Each of the facing members 11 and 12 has a substantially flat or planar surface, 11*a* and 12*a*, respectively, and a substantially flat or planar inner surface 11*b* and 12*b*, respectively which define a width dimension A, the inner surfaces, 11*b* and 12*b*, opposing each other; the facing members 11 and 12 additionally each have an upper substantially flat or planar surface 11*c* and 12*c*, respectively, and a lower substantially flat or planar surface 11*d* and 12*d*, respectively, which define a height dimension B, and a first end substantially flat or planar surface 11*e* and 12*e*, respectively, and a second end substantially flat or planar surface 11*f* and 12*f*, respectively, defining a length dimension C. As is inherent in a three dimensionally rectangular figure, the planar surfaces 11*c*, 11*d*, 11*e* and 11*f* and 12*c*, 12*d*, 12*e* and 12*f*, respectively, are at substantially right angles to the planar surfaces 11*a* and 11*b* and 12*a* and 12*b*, respectively.

Core member 13 is also three dimensionally rectangular, with a first outer surface 14 and a second outer surface 15, an upper surface 16, a lower surface 17, a first end surface 18 and a second end surface 19. Core member 13 is shaped and configured to extend between the opposing inner surfaces 11*b* and 12*b* of facing members 11 and 12 which are aligned in parallel. The first and second outer surfaces 14 and 15 of core member 13 contact and correspond with the respective inner surfaces 11*b* and 12*b*. An adhesive means 20 is utilized to affix surfaces 14 and 15 to surfaces 11*b* and 12*b*, respectively. In the preferred embodiment of the invention, the adhesive means 20 may be an epoxy bonding agent or other means. While the facing members 11 and 12 are formed of concrete in the preferred embodiment, other material may be substituted.

In the preferred embodiment of the invention, as is shown in FIG. 2, the upper planar surface of the core member 13, and the plane defined by it, extends a distance "E" above the plane defined by the parallel upper surfaces 11*c* and 12*c*.

The core element 13 additionally contains one or more cavities or apertures 21 defined by the core member 13 and running between and through its upper surface 16 and lower surface 17 substantially parallel to surfaces 11*a* and 12*a* of facing members 11 and 12.

The block 10 will optimally have a pair of such apertures 21, but different embodiments may have none as shown in FIG. 1, one as shown in FIG. 8, or any other number.

In the preferred embodiment, one aperture 21 is centered approximately on line a—a longitudinally bisecting the upper surface of core member 13, at a point 22*a* located equidistant between the first end surface 18 and a point equidistant between surface 18 and a point 22 equidistant between surfaces 18 and 19, and another aperture 21 is centered approximately on line a—a at a point 22*b* equidistant between second end surface 19 and said point 22. Stated otherwise, one aperture 21 is located at a point 22*a* at a distance from surface 18 equal to one quarter of the distance from end 18 to end 19 and a second aperture 21 is located at a point 22*b* at a distance from surface 19 equal to one quarter of the distance from end 18 to end 19 as shown in FIG 3.

Another feature of the invention as particularly demonstrated in cross section in FIG. 2 includes a linear groove or indentation 30 having a defined depth "D" in the upper surface of core element 13 running through and between end surfaces 18 and 19. In the preferred embodiment of the invention, this indentation 30 is approximately centered linearly between the facing members 11 and 12, and is inwardly rectangular in shape.

The core element 13 also has a protrusion 40 of a defined height F on its lower surface 17. In the preferred embodiment, this protrusion 40 is outwardly rectangular in configuration and is centered linearly on element 13 between facing members 11 and 12 and is equal in length to length dimension C. Protrusion 40 is configured to fit within an indentation equivalent to indentation 30 in a male-female relationship.

A further feature of the invention provides for an indentation 30 of substantially greater depth D than the height F of protrusion 40 so as to provide that when the protrusion 40 of a block 10 is filled within the indentation 30 of a like block 10 in male-female relationship, the depth D of indentation 30 beyond and the height F of the corresponding protrusion 40 of a like block 10 defines a linear aperture 41, running between the end surfaces 18 and 19 of core element 13 of the block 10 in which the corresponding protrusion 40 is inserted this feature is demonstrated in FIG 6.

Figure 13:
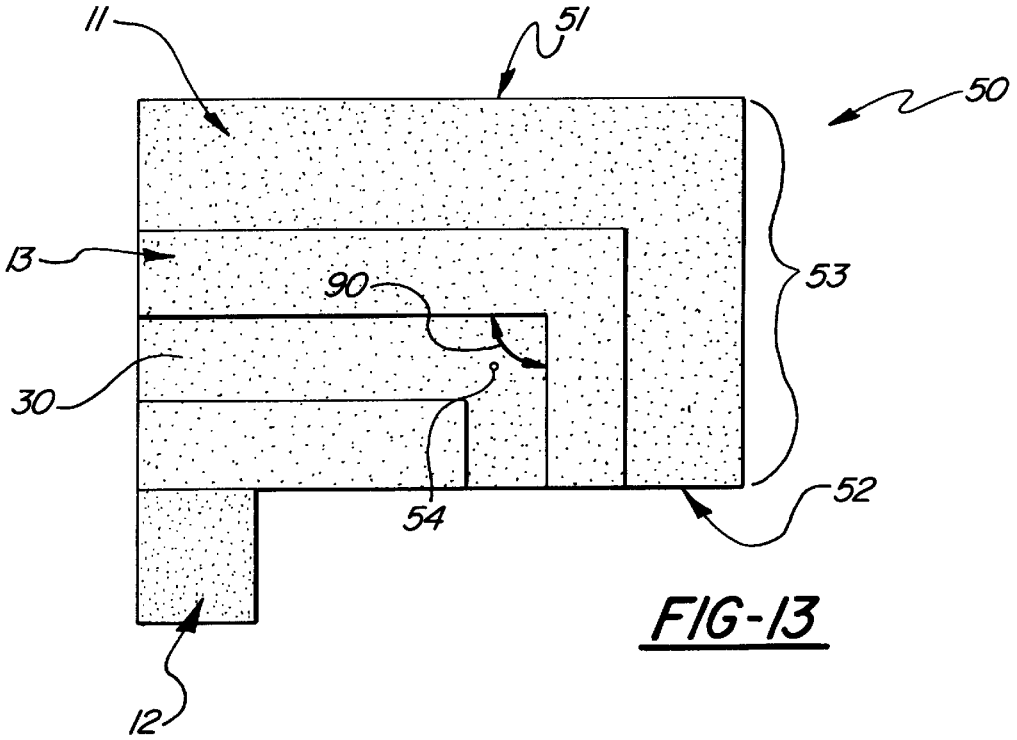
FIG. 13 is a top view of an alternative embodiment of an insulated masonry corner block device.
Figure 14:
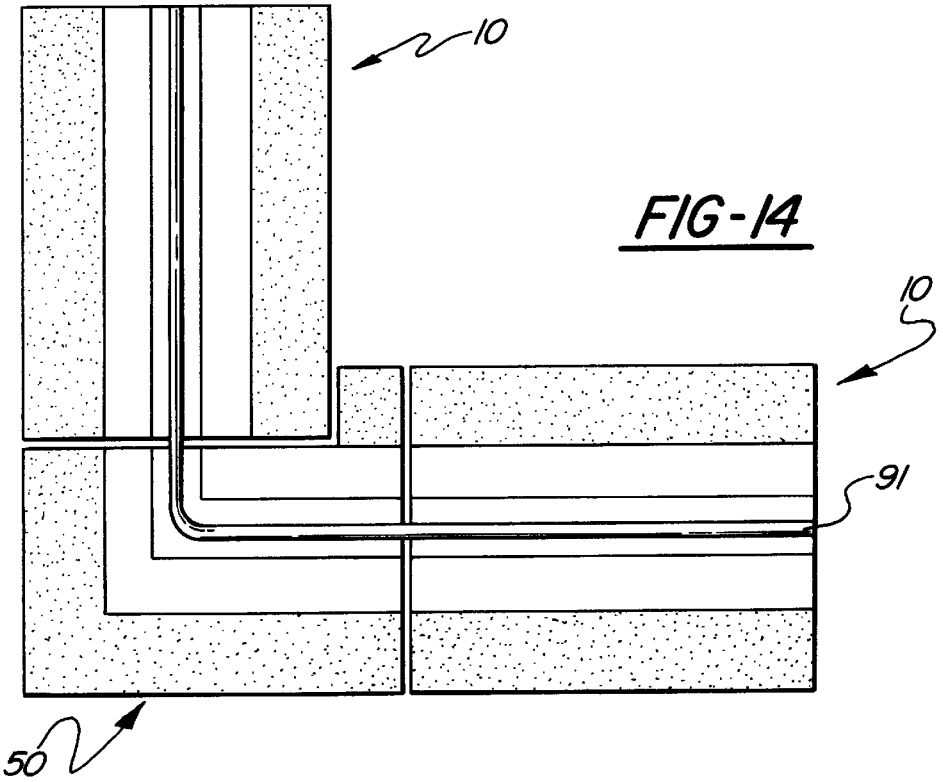
FIG. 14 is a top view of an alternative embodiment of an insulated masonry corner block device forming a corner in conjunction with a pair of standard insulating masonry blocks and a rigid support member within the surface indentation on all of said blocks.

The invention may also be optimally configured as corner block 50, as illustrated in FIGS. 13 and 14. Corner block 50 is configured so that the first facing member 11 comprises a first rectangular element 51 and a second rectangular element 52. Each of the rectangular elements 51 and 52 has a lower surface 11*d* and an upper surface 11*c* defining its height B, an outer surface 11*a* and inner surface 11*b* defining its width A and a first end surface 11*e* and second end surface 11*f* defining its length C. The width A and height B of the first element 51 and second element 52 are uniform. The upper surfaces 11*c* and lower surfaces 11*d* of elements 51 and 52 correspond and said second element 52 extends outwardly at right angles from the inner surface 11*b* of the first element 51 such that the second end surface 11*f* of the first element 51 and the outer planar surface 11*a* of the second element 52 defines a unitary, singular plane 53. The second facing member 12 of the corner block 50, as in base block 10, has a substantially outer planar surface 12*a*, a substantially planar inner surface 12*b*, a substantially planar upper surface 12*c*, a substantially planar lower surface 12*d*, a substantially planar first end surface 12*e* and a substantially planar second end surface 12*f*. In the corner block 50 embodiment of the invention, the second member 12 has a length C substantially less than the length C of the first facing member 11, with the first end planar surfaces 11*e* and 12*e* defining a singular plane, the upper surfaces 11*e* and 12*c* defining a singular plane and the lower surfaces 11*d* and 12*d* defining a singular plane.

The core element 13 in corner block 50 is generally configured as in block 10 except that its second end surface 19 abuts and is affixed to the inner surface 11*b* of the second element 52 of facing member 11. Further, the linear groove or indentation 30 on the upper surface 16 of core member 13, for corner block 50, runs from and through end surface 18, approximately centered linearly between the first element 51 of facing member 11 and facing member 12 to a point 54 on upper surface 16 approximately equidistant between the inner surfaces 11*b* of the first member 51 and second member 52 and then at right angles parallel to the inner surface 11*b* of second member 52 to and through the second outer surface 15 of core element 13. It is additionally desirable to provide a linear protrusion 40 of defined depth D on corner block 50 essentially as provided for base block 10 except that protrusion 40 on block 50 shall be configured to fit within the linear indentation 30 of a like corner block 50 in a male-female relationship. Additionally, desirable features specifically provided for base block 10, include, but are not limited to, such innovations as extending the height of core element 13 by E, providing for greater depth D of indentation 30 to allow formation of aperture 41, and substitution of materials and means of affixing facing members 11 and 12 to core 13 are also applicable, and directed to block 50 in the preferred embodiment. FIGS. 13 and 14 demonstrate a top view of corner block 50.

In a further embodiment of the invention an alternative corner block 60 is provided, as shown in FIG. 5. Corner block 60 is comprised of a first facing member 61 and second facing member 62. Each facing member 61 and 62 further comprises a first rectangular element 63 and second rectangular element 64. Elements 63 and 64 each have a respective upper planar surface, 63*c* and 64*c*, and a respective lower planar surface, 63*d* and 64*d*, defining height dimension B, respective outer planar surfaces 63*a* and 64*a* and respective inner planar surfaces 63*b* and 64*b* defining width dimension "A," and respective first end planar surfaces 63*e* and 64*e* and respective second end planar surfaces 63*f* and 64*f*, defining respective length dimension C1 as to first rectangular element 63 of first facing member 61, C2 as to first rectangular element 63 of second facing member 62, C3 as to second rectangular element 64 of first facing member 61, and C4 as to second rectangular element 64 of second facing member 62. The upper surfaces 63*c* and 64*c* of each facing member 61 and 62 correspond and the inner surfaces 63*b* and 64*b* of each facing member 61 and 62 oppose each other, respectively, for elements 63 and 64 of each facing member 61 and 62, in parallel. The second element 64 of the first facing member 61 extends outward at right angles from the inner surface 63*b* of the first element 61 such that the second end surface 63*f* of first rectangular element 63 and the outer surface 64*a* of the second element 64 form a singular plane, with the second element 64 of second facing member 62 extending outward at right angles from the outer surface 63*a* of second rectangular element 64, so that the second end surface 63*f* of first element 63 of second facing member 62 and inner surface 64*b* of second element 64 of second facing member 62 define a singular plane.

In a further embodiment of the present invention, an insulated masonry block wall assembly 80 may be constructed. A view of masonry block wall 80 is shown in FIG. 6. The insulated masonry block wall assembly 80 comprises a series or plurality of masonry blocks 10 arranged in linear alignment as shown in FIG. 6 to form a base course 81 of masonry blocks 10, as previously described herein, in detail, with each block 10 having a core member 13 and a uniformly planar lower surface 17. The series of masonry blocks 10 are arranged in course 81 so that the second end surface 19 of each block 10 abuts and interfaces with, to form a common boundary 82, with the next adjacent block 10. The core member 13 of each block 10 in course 81 has a linear groove or indentation 30 of defined depth D as previously defined and one or more vertical apertures 21 as previously defined.

A second series of masonry blocks 10, as defined for base course 81, with the additional feature on each block 10 of a protrusion 40 on the lower surface 17, as previously described in detail, is arranged substantially as course 81, in linear alignment as shown in FIG. 6, to form a first upper course 83. Course 83 is linearly aligned on course 81 so that the lower flat or substantially planar surfaces 11*d* and 12*d* of each block 10 of course 83, oppose, approximate and interface, by forming a common boundary 84 with the flat upper surfaces 11*c* and 12*c* of one or more of blocks 10 of course 81, with the linear protrusion 40 of each block 10 of course 83 configured with a portion of indentation 30 of one or more blocks 10 of course 81 in a male female relationship. In the preferred embodiment, the depth D of indentation 30 is substantially greater than the height F of protrusion 40, so as to define a linear aperture 41 running the length 87 of each course 81 and 83. In the preferred embodiment of insulated masonry block wall assembly 80, each block 10 is linearly aligned in each course 81 and 83 so that the linear aperture 41 runs the entire length 87 of each course. Likewise, in the preferred embodiment, there is a plurality of sequential upper courses 88 constructed substantially as first upper course 83 with each course of the sequential courses 88 abutting and aligned linearly with the course below in substantially the same manner as the first upper course 83 abuts and is aligned with base course 81. In the preferred embodiment, each block 10 of first upper course 83 is aligned so that its flat lower surfaces 11*d* and 12*d* oppose, approximate and interface with approximately equal portions 85 and 86 of the flat upper surfaces 11*c* and 12*c* of two adjoining blocks 10 of base course 81. Each of the sequential upper courses 88 is similarly aligned with the course immediately below it, so that the apertures 21 of each block 10, in each course 81, 83 and 88 are aligned so that each aperture 21 extends in combination the entire height 89 of the insulated block wall assembly 80. In the primary embodiment, each block 10 of each course 81, 83 and 88 is joined to the next succeeding block in series at common boundary 82 by a concrete or mortar 90 joint and each block 10 of each course 81, 83 and 88 is joined to a portion of two blocks 10 of the preceding course and common boundary 84 by a concrete or mortar 90 joint.

In the preferred embodiment, a rigid support member or rod 91 commonly referred to in masonry trade as re-rod, reinforcing rod, rebar and/or reinforcing bar, is inserted within aperture 41 running through length 87 of one or more of the base course 81, first upper course 83 and sequential upper courses 88. The balance of any aperture 41, to the extent that said rod does not completely fill such aperture 41, may be filled with concrete or mortar 90 for increased linear strength and stability. Likewise, a rod 41 is inserted vertically through a plurality of the aligned apertures 21 of the blocks 10 of each course through the entire height for increased vertical strength and stability. These support members or rods, as described above, in both horizontal and vertical applications, are shown in FIGS. 5, 6, 9 and 12.

In the preferred embodiment, the rod or member 91 is configured to fit within the entire aperture 41 or 21, respectively, and may be entirely of concrete or mortar 90 or other pourable material, or a rod of metal or other rigid material, or a combination thereof. The invention wall assembly 80, may also, optimally, permit angled walls by incorporating at an end of each course, a corner block 60 as shown on FIG. 5, and as described previously in detailed, or a corner block 50 as shown in FIGS. 13 and 14 and described previously in detail.

Whereas, a preferred embodiment of the invention has been illustrated and described in detail, it will be apparent that various changes may be made in the disclosed embodiment without departing from the spirit of the invention.

What is claimed is:

1. An insulated masonry block comprising:

a first masonry facing member;

a second masonry facing member correspondingly aligned in parallel with said first member;

each facing member further comprising an outer substantially planar surface and an opposing inner substantially planar surface defining a width dimension; an upper substantially planar surface and lower substantially planar surface, defining a height dimension a first end substantially planar surface and second end substantially planar surface, defining a length dimension, the respective planes of said upper, lower and end planar surfaces being at substantially right angles with the planes defined by the outer and inner surfaces of said parallel first and second facing members;

a substantially three-dimensionally rectangular core member of rigid insulating material configured to extend between the opposing inner surfaces of the parallel facing members;

said core member having a first outer surface and second outer surface contacting and corresponding, respectively, to the opposing inner surfaces of the first and second facing members, an upper surface, a lower surface, and two end surfaces;

an adhesive means for affixing the inner surfaces of said facing members to the contacting outer surfaces of said core member; and said core member further defines a linear indentation of a defined depth in its upper surface running between and through the two end surfaces of said core member.

2. An insulated masonry block according to claim 1, wherein said core member further comprises a linear protrusion of a defined height, on its lower surface running between the two end surfaces of said core member, said protrusion being configured to fit within a like indentation as described in said claim 1 in a male-female relationship.

3. An insulated masonry block according to claim 2, wherein said protrusion and said indentation are substantially rectangular.

4. An insulated masonry block according to claim 2, wherein said indentation is of a depth greater than the height of said protrusion.

5. An insulated masonry block comprising:

a first masonry facing member comprising a first rectangular element and second rectangular element, each having a lower surface and upper surface defining its height, an outer surface and inner surface defining its width, and a first end surface and second end surface defining its length, said upper and lower surfaces of said first and second elements being in respective upper and lower parallel planes and said second element extending outward at right angles from the inner surface of said first element such that said second end surface of the first element and said outer surface of the second element define a singular plane;

a second masonry facing member having a lower surface and upper surface defining its height, and outer surface and inner surface defining its width and a first end surface and second end surface defining its length, said inner surface opposing the inner surface of the first element of said first facing member, the first end surfaces of said first and second facing members defining a singular plane, the upper surfaces of said first and second members defining a singular plane, and the lower surfaces of said first and second facing members defining a singular plane;

said second facing member having a length substantially less than the length of said first facing member;

a substantially three-dimensionally rectangular core member of rigid insulating material configured to extend between the opposing inner surfaces of the first and second facing member;

said core member having a first outer surface contacting and corresponding with the inner surface of the first element of the first facing member, an opposite second outer surface, corresponding, in part, with the inner surface of said second facing member, a first planar end surface in the same plane as defined by the first ends of the first and second facing members, and a second end surface contacting and corresponding to the inner surface of the second element of the first masonry facing member;

an adhesive means for affixing the inner surfaces of the first and second elements of the first facing member and the inner surface of the second facing member to the contacting surfaces of said core member;

wherein said core member further defines a linear indentation of a defined depth in its upper surface, said indentation running at right angles from and through the first end surface of said core member to a point on the upper surface of said core member equidistant between the inner surfaces of said first element and second element and then at right angles parallel to the length dimension of the second rectangular element to and through the second outer surface of said core member; and said core member further comprises a linear protrusion of defined height on its lower surface, said protrusion being configured to fit within said linear indentation, in a male-female relationship.

6. An insulated masonry block according to claim 5, wherein said protrusion and said indentation are substantially rectangular in cross section.

7. An insulated masonry block according to claim 5, wherein said indentation is of a depth greater than the height of said protrusion.

8. An insulated masonry block comprising:

a first masonry facing member and a second masonry facing member each comprising a first rectangular element and a second rectangular element, each rectangular element having a lower surface and upper surface defining its height, an outer surface and inner surface defining its width, and a first end surface and second surface defining its length, said upper and lower surfaces of said first and second elements of each facing member being in respective upper and lower parallel planes; the inner surfaces of the first and second masonry facing members opposing each other, in parallel;

the second element of the first facing member extending outward at right angles from the inner surface of said first element, such that the second end surface of the first element and the outer surface of the second element define a singular plane; the first element of the second facing member being aligned so that the length dimension of its upper surface is parallel to the length dimension of the upper surface of the first element of the first facing member; said second element of the second facing member extending outward at right angles from the outer surface of said first element such that the second end surface of the first element and said inner surface of the second element define a singular plane;

the first end surface and second end surface of the first element of each facing member being in a singular vertical plane and the second end surface of the second element of each facing member being a singular vertical plane;

a core member of rigid insulating material having an upper substantially planar surface and a lower substantially planar surface, configured to extend between the opposing inner surfaces of the first and second facing members;

said core member having a first outer surface and a second outer surface contacting and corresponding, respectively, to the entire opposing inner surfaces of the first and second facing members, and two substantially planar end surfaces;

an adhesive means for affixing the inner surfaces of said facing members to the contacting outer surfaces of said core member; and said core member further defines a linear indentation of a defined depth in its upper surface, said indentation running at right angles from and through the first end surface of said core member to a point on the upper surface of said core member approximately equidistant between the inner surfaces of said first element and second elements and at right angles from said point parallel to the inner face of said second rectangular element to and through the second outer surface of said core member.

9. An insulated masonry block according to claim 8, wherein said core member further comprises a linear protrusion of defined height on its lower surface, said protrusion being configured to fit within a like indentation as described in said claim 8, in a male-female relationship.

10. An insulated masonry block according to claim 9, wherein said protrusion and said indentation are substantially rectangular.

11. An insulated masonry block according to claim 10, wherein said indentation is of a depth greater than the height of said protrusion.

12. An insulated masonry block wall assembly, comprising:

A. a first plurality of masonry blocks, each block comprised of:

a first masonry facing member;

a second masonry facing member correspondingly aligned in parallel with said first member;

each facing member further comprising an outer substantially planar surface and an opposing inner substantially planar surface defining a width dimension; an upper substantially planar surface and lower substantially planar surface, defining a height dimension a first end substantially planar surface and second end substantially planar surface, defining a length dimension, the respective planes of said upper, lower and end planar surfaces being at substantially right angles with the planes defined by the outer and inner surfaces of said parallel first and second facing members;

a substantially three-dimensionally rectangular core member of rigid insulating material configured to extend between the opposing inner surfaces of the parallel facing members;

said core member having a first outer surface and second outer surface contacting and corresponding, respectively, to the opposing inner surfaces of the first and second facing members, an upper surface, a lower surface, and two end surfaces, with the first and second outer surfaces extending above the plane defined by the upper surfaces of said facing members; and an adhesive means for affixing the inner surfaces of said facing members to the contacting outer surfaces of said core member;

a plurality of apertures defined by and extending through said core member between and through its upper surface and lower surface, one aperture being centered at a point equidistant between a point equidistant between the two end surfaces and one end surface and one aperture centered equidistant between a point equidistant between the two end surfaces and the other end surface; and said core member further defining a linear indentation of a defined depth in its upper surface running between and through the two end surfaces of said core member;

B. a second plurality of masonry blocks according to said first plurality A, wherein said core member further comprises a linear protrusion of a defined height, on its lower surface, running between the two end surfaces of said core member, said protrusion being configured to fit within a like indentation as described in said first plurality of masonry blocks, in a male-female relationship;

said first plurality of blocks being linearly aligned in a base course of blocks so that the second end planar surfaces of each block oppose and approximate the first end planar surfaces of the succeeding block in said linear arrangement;

said second plurality of blocks likewise linearly aligned in a first upper course so that the lower substantially planar surfaces of the facing members of each block of said first upper course oppose and approximate the upper substantially planar surface of the blocks of said base course;

a plurality of additional sequentially upper courses of said second plurality of blocks, likewise linearly aligned so that the lower planar surfaces of the facing members of each successive course oppose and approximate the substantially planar upper surfaces of the preceding course of blocks; and a means for joining individual blocks in linear alignment and a means for joining said base, first upper, and sequentially upper courses of blocks.

13. An insulated masonry block wall assembly according to claim 12, wherein said base course, first upper course, and additional sequential upper courses are linearly aligned so that the apertures defined by the core members of the blocks in each course are vertically aligned with the apertures defined by the core members of the blocks in the other courses.

14. An insulated masonry block wall assembly, according to claim 13, wherein a plurality of rigid support members configured to fit within the apertures defined by said core members are vertically mounted within said apertures of a plurality of said base, first upper, and sequentially upper courses.

15. An insulated masonry block wall assembly, according to claim 12, wherein the respective opposing and approximate end surfaces are joined to each other by a mortar joint.

16. An insulated masonry block wall assembly, according to claim 12, wherein the upper surfaces of each of the face elements of the blocks in each course are joined to the lower surfaces of the face elements of the opposing upper course by a mortar joint.

17. An insulated masonry block wall assembly, according to claim 12, wherein said assembly further comprises a third plurality of masonry blocks according to said second plurality B, wherein said linear indentation defined by said core member is of a defined depth greater than the defined height of the linear protrusion of said core member of said second plurality of blocks; and one or more rigid support members are configured to fit within the aperture defined by said third plurality of blocks.

18. An insulated masonry block wall assembly, according to claim 14, wherein one or more of said rigid support members are formed of poured concrete.

19. An insulated masonry block wall assembly, according to claim 14, wherein one or more of said support members are comprised of a rigid rod member surrounded by poured concrete.

20. An insulated masonry block wall assembly according to claim 17, wherein one or more of said rigid support members are formed of poured concrete.

21. An insulated masonry block wall assembly according to claim 17, wherein one or more of said rigid support members are comprised of a rigid rod member, surrounded by poured concrete.

22. An insulated masonry block wall assembly, according to claim 12, wherein said insulated masonry block wall assembly further comprises:

C. a first plurality of masonry corner blocks, each block comprised of:

a first masonry facing member comprising a first rectangular element and second rectangular element, each having a lower surface and upper surface defining its height, an outer surface and inner surface defining its width, and a first end surface and second end surface defining its length, said upper and lower surfaces of said first and second elements corresponding and said second element extending outward at right angles from the inner surface of said first element such that said second end surface of the first element and said outer surface of the second element define a singular plane;

a second masonry facing member having a lower surface and upper surface defining its height, and outer surface and inner surface defining its width and a first end surface and second end surface defining its length, said inner surface opposing the inner surface of the first element of said first facing member, the first end surfaces of said first and second facing members defining a singular plane, the upper surfaces of said first and second members defining a singular plane, and the lower surfaces of said first and second facing members defining a singular plane;

said second facing member having a length substantially less than the length of said first facing member;

a substantially three-dimensionally rectangular core member of rigid insulating material configured to extend between the opposing inner surfaces of the first and second facing member;

said core member having a first outer surface contacting and corresponding with the inner surface of the first element of the first facing member, an opposite second outer surface, corresponding, in part, with the inner surface of said second facing member, a first planar end surface in the same plane as defined by the first ends of the first and second facing members, and a second end surface contacting and corresponding to the inner surface of the second element of the first masonry facing member; and an adhesive means for affixing the inner surfaces of the first and second elements of the first facing member and the inner surface of the second facing member to the contacting surfaces of said core member;

said masonry block being configured so as to provide a means for extending said insulated masonry block wall assembly at right angles from the linear alignment of said base first upper and sequentially upper courses.

23. An insulated masonry block wall assembly, according to claim 12, wherein said insulated masonry block wall assembly further comprises:

D. a second plurality of masonry corner blocks, each block comprised of:

a first masonry facing member and a second masonry facing member each comprising a first rectangular element and a second rectangular element, each rectangular element having a lower surface and upper surface defining its height, an outer surface and inner surface defining its width, and a first end surface and second surface defining its length, said upper and lower surfaces of said first and second elements of each facing member being in respective upper and lower parallel planes; the inner surfaces of the first and second masonry facing members opposing each other, in parallel;

the first element of the second facing member being aligned so that the length dimension of its upper surface is parallel to the length dimension of the upper surface of the first element of the first facing member; the second element of the first facing member extending outward at right angles from the inner surface of said first element, such that the second end surface of the first element and the second outer surface of the second element define a singular plane; said second element of the second facing member extending outward at right angles from the outer surface of said first element such that the second end surface of the first element and said inner surface of the second element define a singular plane;

the first end surface and second end surface of the first element of each facing member defining a singular parallel plane and the second end surface of the second element of each facing member defining a singular parallel plane;

a core member of rigid insulating material having an upper substantially planar surface and a lower substantially planar surface, configured to extend between the opposing inner surfaces of the first and second facing members;

said core member having a first outer surface and a second outer surface contacting and corresponding, respectively, to the entire opposing inner surfaces of the first and second facing members, and two substantially planar end surfaces; and an adhesive means for affixing the inner surfaces of said facing members to the contacting outer surfaces of said core member;

said masonry block being configured so as to provide a means for extending said insulated masonry block wall assembly at right angles from the linear alignment of said base first upper and sequentially upper courses.

24. An insulated masonry block wall assembly, according to claim 22, wherein said facing members are comprised of concrete.

25. An insulated masonry block wall assembly, according to claim 22, wherein said plurality of masonry corner blocks C have a core member comprised of polystyrene.

26. An insulated masonry block wall assembly, according to claim 22, wherein said adhesive means comprises an epoxy bonding agent.

27. An insulated masonry block wall assembly, according to claim 22, wherein the upper surface and a portion of the outer surfaces and end surfaces of said core member of plurality of masonry corner blocks C extend above the plane defined by the upper surfaces of said facing member.

28. An insulated masonry block wall assembly, according to claim 23, wherein said facing members are comprised of concrete.

29. An insulated masonry block wall assembly, according to claim 23, wherein said second plurality of masonry corner blocks D have a core member comprised of polystyrene.

30. An insulated masonry block wall assembly, according to claim 23, wherein said adhesive means comprises an epoxy bonding agent.

31. An insulated masonry block wall assembly, according to claim 23, wherein the upper surface and a portion of the outer surfaces and end surfaces of said core member of plurality of masonry corner blocks D extend above the plane defined by the upper surfaces of said facing member.

* * * * *